United States Patent [19]

Wentworth

[11] Patent Number: 4,653,980

[45] Date of Patent: Mar. 31, 1987

[54] MECHANICAL SEAL FOR PUMPS AND METHOD OF FABRICATING SAME

[75] Inventor: Robert S. Wentworth, Temecula, Calif.

[73] Assignee: Borg-Warner Industrial Products, Inc., Long Beach, Calif.

[21] Appl. No.: 770,474

[22] Filed: Aug. 29, 1985

[51] Int. Cl.[4] ..... F01D 29/08

[52] U.S. Cl. ..... 415/173 R; 277/88; 277/92; 264/262

[58] Field of Search ..... 415/170 R, 170 A, 171, 415/173 R, 173 A, 174; 277/88, 89, 92, 95, 166, 81 R; 418/104; 264/102, 262, 267, 268; 384/295, 296

[56] References Cited

U.S. PATENT DOCUMENTS

| | | | |
|---|---|---|---|
| 2,233,624 | 3/1941 | Magnesen | 277/92 |
| 2,871,039 | 1/1959 | Payne | 277/92 |
| 3,138,942 | 6/1964 | Kayser | 277/95 |
| 3,194,569 | 7/1965 | Utvitch | 277/92 |
| 3,643,967 | 2/1972 | Stahl | 277/92 |
| 3,904,211 | 9/1975 | Dega | 415/170 A |
| 4,239,241 | 12/1980 | Menager | 277/92 |
| 4,509,773 | 4/1985 | Wentworth | 415/170 A |

*Primary Examiner*—Robert E. Garrett
*Assistant Examiner*—John Kwon
*Attorney, Agent, or Firm*—John W. Harbst

[57] ABSTRACT

A mechanical seal assembly for use with centrifugal pumps including at least one unitized elastomer assembly for urging the seal faces of a pair of seal rings into sealing engagement with each other. The unitized elastomer assembly serves as a seal ring mounting arrangement and includes a spaced pair of metallic rings which are chemically bonded to an annular elastomer body disposed therebetween and whose cross section between the rings is loaded in shear when the elastomer assembly is operatively arranged in the pump. A mechanical seal is established between at least one of said rings and the elastomer body for protecting the chemical bond therebetween against attack by corrosive pump product.

28 Claims, 14 Drawing Figures

MECHANICAL SEAL FOR PUMPS AND METHOD OF FABRICATING SAME

FIELD OF THE INVENTION

The present invention relates to centrifugal pumps and, more particularly, to a novel form of a rotary mechanical seal of the type illustrated and shown in my U.S. Pat. No. 4,418,919 entitled "Mechanical Seals With Setting Block For Use With Slurry Pumps", over which the present seal is an improvement.

BACKGROUND OF THE INVENTION

The type of seal with which the present invention is concerned is designed for use with pumps in a harsh environment of slurry and/or precipitative liquids. The seal assembly serves to separate and seal a rotary drive shaft to a centrifugal pump housing having a shaft opening through which the shaft extends. The seal assembly, generally includes a nonrotating seal ring connected to the pump housing and a rotatable seal connected to the pump shaft, each seal ring having a lapped seal face opposing the seal face on the other ring. One or both of the seal rings may be axially movable and resiliently urged toward one another by springs or other independent devices to assure seal face engagement.

Inherent problems result when seals are disposed in harsh environments involving slurries and/or precipitative fluids. In such environments, the normal radial deflections and errors of positioning the pump shaft are greatly exaggerated. Moreover, problems caused by abrasion and corrosion of the parts and jamming of the springs by solids and precipitates are ever present. Unless extraneous and costly devices are used in conjunction with the seal assembly, conventional seal designs are impractical in such environments. That is, unless a separate cleansing fluid flow is continuously provided for a conventional seal assembly, a brittle hard precipitate accumulates about and eventually encrusts the seal assembly thereby reducing the flexibility between the seal faces ultimately destroying the seal's effectiveness. As may be appreciated, there are substantial commercial and practical advantages in operating a pump with little or no such extraneous cleansing equipment and/or liquids.

In answer to Industry's problems, my above mentioned patented seal, because of its unique design, has proven very effective for use with centrifugal pumps moving abrasive slurry and/or precipitative fluids under pressure. My patented seal comprises the customary stationary and rotatable seal rings, each having a seal face in juxtaposed relation. The seal rings are resiliently urged into a sealing relationship by at least one elastomeric assembly. The elastomeric assembly includes an annular elastomer ring which is chemically bonded to a pair of radially spaced inside and outside metal bands or rings. The outside support ring and a portion of the elastomer body are exposed to the pump product while the inside ring is removed from the pressurized/corrosive pump product and serves to operatively connect the elastomer assembly to the pump housing. The design is such that the assembly supports one of said seal rings such that the elastomer body disposed between the support rings is placed in shear when the seal is assembled in place within the pump housing. This design allows the elastomer body to absorb the radial forces that are inherent with centrifugal pumps and permits limited radial shifting between the seal rings.

Despite these advantages, difficulties have been encountered when the seal assembly is disposed in an environment wherein a highly corrosive and/or caustic matter is being pumped under elevated pressures. Because the outside ring and the elastomer body are exposed to pump product, the chemical agent which bonds these elements into an operative assemblage is subject to attack by the pump product. In those applications where the caustic nature of the pump product has a greater corrosive effect on the bonding agent than it does on the elastomer itself, the pump product attacks and deteriorates the chemical bond joining the support ring to the elastomer body. Eventually, the bond fails thus resulting in premature seal failure.

SUMMARY OF THE INVENTION

In view of the above, the present invention incorporates the distinct advantages of the patented design and is uniquely designed to overcome the above noted limitations. Toward this end, the present invention contemplates the provision of an improved rotary mechanical seal assembly and method for fabricating same.

The mechanical seal assembly of the present invention includes a pair of seal rings whose end faces are disposed in a juxtaposed sealant relationship. One or more of the seal rings is operably supported by an elastomer assembly which may engage the supported seal ring by means of a pressfit frictional connection or a positive drive pin type connection. In either form, the elastomer assembly provides a biasing axial force for maintaining the seal faces in sliding engagement relative to each other and permits the seal assembly to be mounted from the impeller side of the housing. The elastomer assembly includes an annular elastomeric or rubber body whose inside and outside edges engage and are chemically bonded to a pair of spaced nonresilient metal rings. The area of the elastomer body between said rings is loaded in shear when the seal assembly is disposed in its operative position. Where the outside metal support ring, which is exposed to the pump product, is in direct contact with the adjacent seal ring, heat developed by the seal rings may be better transferred to the pump product through conduction. The inside support ring is operatively connected to the pump housing and serves as the support ring for the elastomer assembly and the seal ring carried thereby.

A salient feature of the present invention is a mechanical seal for protecting and maintaining the chemical bond which joins or unites the elastomer body and its support ring. This mechanical protection means neither intends to nor does it replace the chemical bond between the rubber body and its support ring. Instead, such means serves to protect the chemical bonding agent from exposure to the caustic, pressurized environment. The protective mechanical means between the elements comprises an open ended channel or groove disposed proximate the end of the exposed support ring and into which an extension or projection of elastomer material flows during a vulcanizing process. Concurrently with the vulcanizing process, or in subsequent operations, the opening to this channel is then crimped. The resultant cross sectional design of the channel prevents pump product from entering the channel, especially when shear forces are applied to the elastomer body. The protective coaction provided between these mechanical parts prevents the caustic pump product from effecting the chemical bond between the parts despite the pressure or corrosive effect of pump product.

In line with the above, the primary object of this invention is the provision of a seal assembly which utilizes shear stresses of an elastomeric body for urging one seal ring against another and which includes means for prolonging the usefulness of the assembly.

Another object of this invention is the provision of a seal assembly which is relatively inexpensive to manufacture but which has unique and long lasting sealant qualities.

DESCRIPTION OF THE DRAWINGS

Having in mind the above objects and other attendant advantages that would be evident from an understanding of this disclosure, the invention comprises the devices, combination and arrangement of parts as illustrated in the presently preferred forms of the invention which are hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
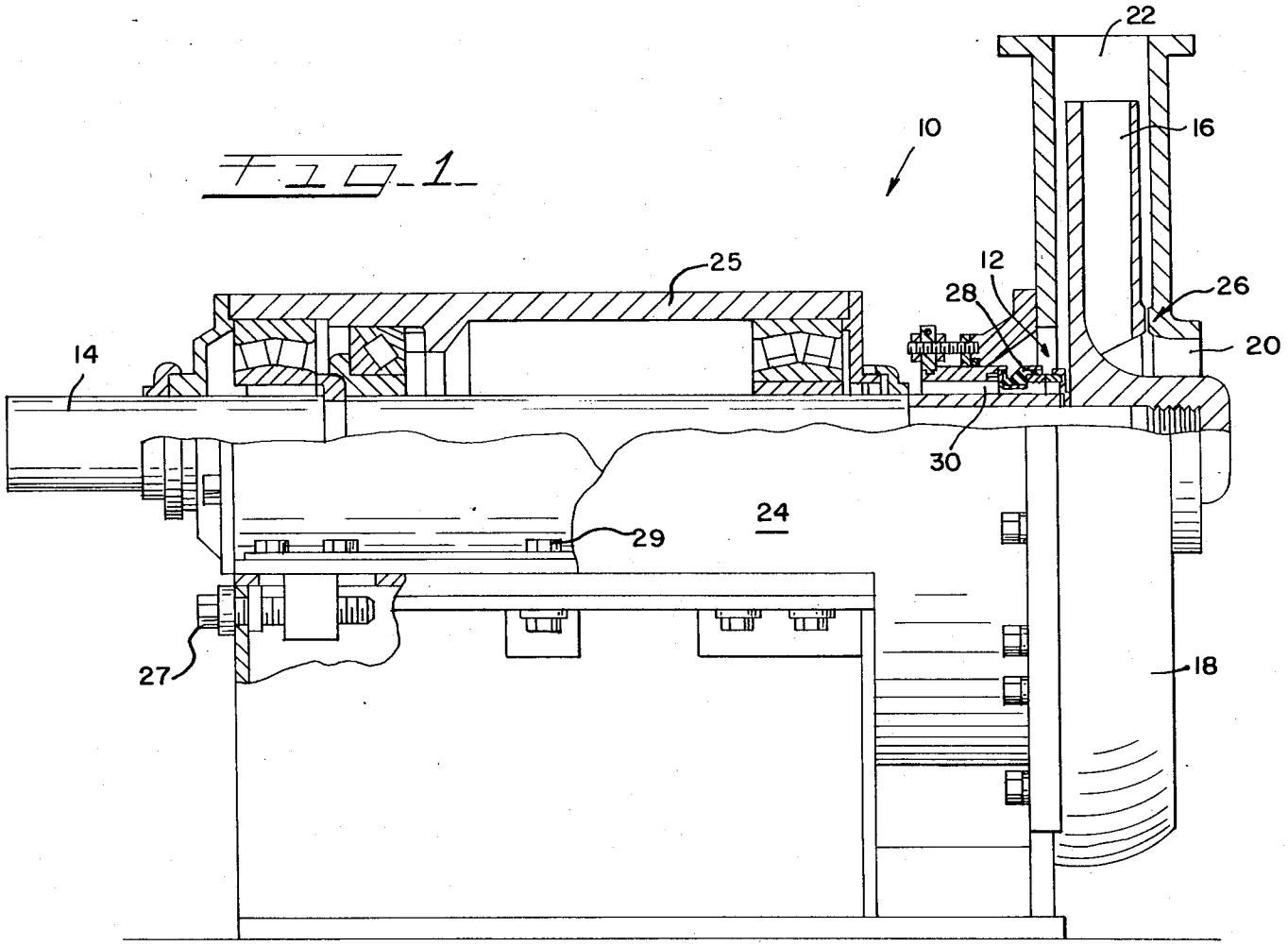
FIG. 1 is an elevational view, with portions broken away and shown in cross section, of a typical centrifugal pump incorporating a mechanical seal assembly constructed in accordance with the present invention.

To simplify the invention's disclosure, the drawings illustrate very little of the pump structure to which the invention is applied. FIG. 1 illustrates a typical pump assembly 10 incorporating a mechanical seal assembly 12. Only so much of the pump assembly is shown as necessary for an understanding of the present invention. Suffice it to say, the pump assembly 10 has a rotatable assemblage including a driven shaft 14 having an impeller 16 connected at one end thereof. The other end of the shaft 14 is connected to a prime mover, such as an electric motor (not shown) or other rotatable means suitable for turning the impeller at relatively high speeds. The impeller 16 is enclosed in a housing 18 wherein a pressurized fluid flow is created between a fluid inlet port 20 and a fluid outlet port 22 as a result of impeller action. The housing 18 may be bolted or otherwise adjustably affixed to a frame assembly 24 which carries a bearing housing 25.

Peculiar to most pumps designed for moving abrasive slurries is some means of axially adjusting the impeller 16 relative to the housing 18. Such adjustment means permit a close yet operable clearance to be maintained in an area generally designated 26. A close tolerance in such area minimizes recirculation of pump product when the impeller wears as a result of the harsh operating environment. In the illustrated design, such adjusting means includes an adjusting screw 27 which, because of its operative association with the bearing housing 25, is capable of modulating the axial disposition of the bearing housing, carrying shaft 14 and impeller 16, relative to the housing 18 and the frame assembly 24. Having modulated the axial disposition of the impeller 16 relative to the housing 18, bolts 29 or other suitable fastener means serve to lock the bearing housing against further movement.

The mechanical seal assembly of this invention is constructed and arranged to substantially retard passage of pumped fluid and/or pump product from the impeller and pump housing 18 along the shaft 14 and ultimately to the motor or atmosphere. That is, the seal arrangement of the present invention provides an essentially fluid tight dynamic seal which retards the passage of pump product between a first zone or chamber 28 wherein there exists pump product at process temperature and pressure and a second zone or chamber 30 extending along the shaft to the motor. It must be appreciated that though the sealant means of this invention may be considered to be essentially fluid tight, some leakage across the seal faces does, of necessity, occur. This is true of all face type mechanical seals and is essential to the prolonged service life of the seal structure.

Figure 2:
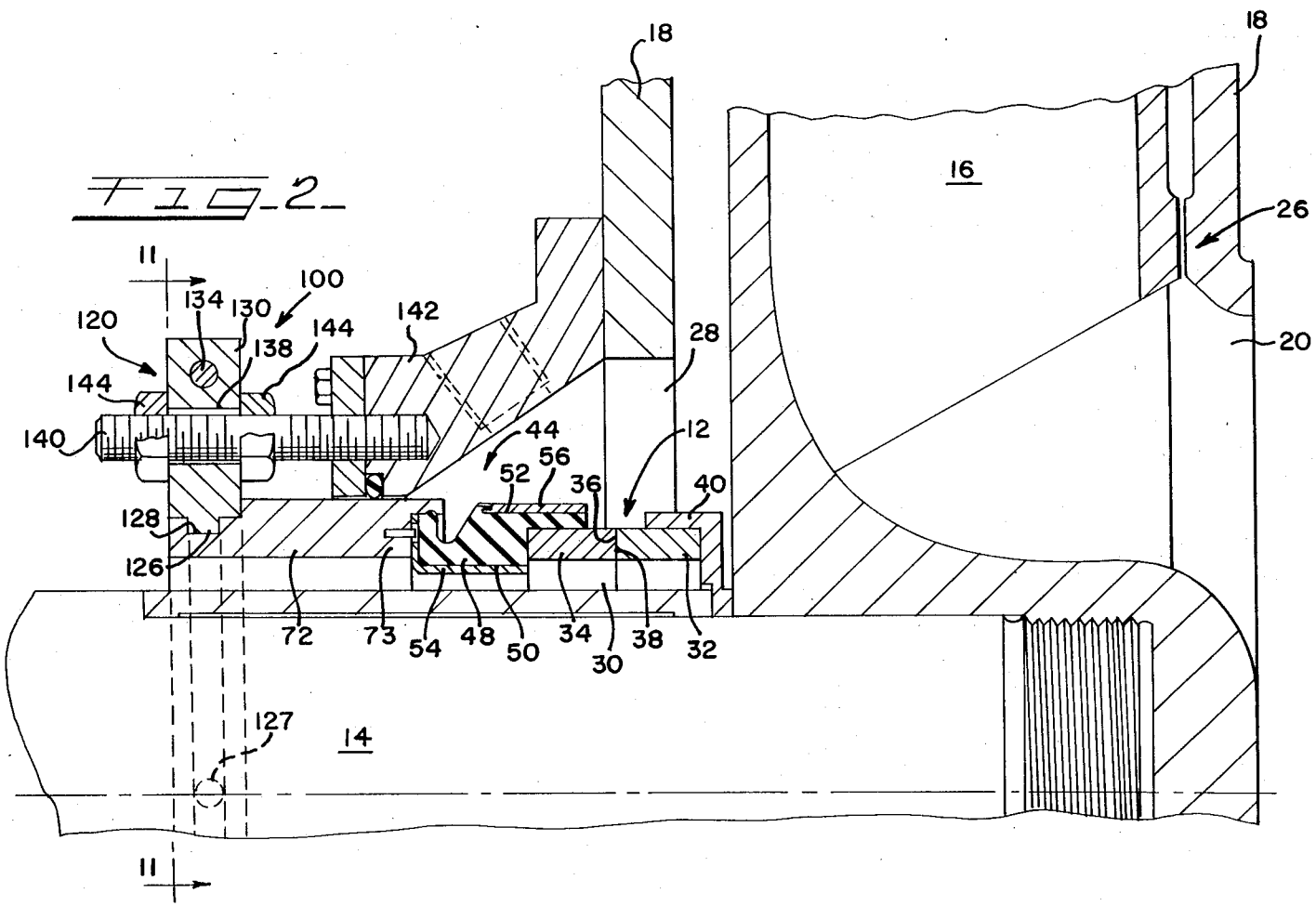
FIG. 2 is an enlarged partial cross sectional view of a preferred embodiment of the mechanical seal assembly of this invention.

As best illustrated in FIG. 2, the mechanical seal assembly 12 comprises a pair of seal rings 32 and 34 which surround the shaft 14. In the presently preferred embodiment, the seal rings 32 and 34 may be substantially identical and are preferably constructed of a ceramic, i.e., silicon carbide, or other suitable wearing material depending on the particular environment in which the pump finds utility. Each seal ring has an opposing lapped seal end face 36 and 38. The abutment of end surface 36 with surface 38 provides the dynamic seal therebetween. The seal ring 32 rotates with the shaft 14 through its connection with a radially stepped cylindrical sleeve 40, the latter being operatively associated with the shaft 14 and abutting the impeller 16. In comparison, the other seal ring 34 is relatively stationary. Unlike other seal arrangements, the mechanical seal assembly 12 of the present invention is mounted from the impeller side of the pump housing by means to be subsequently described. By this construction, the drive assembly and alignment of the coupling between the drive motor and pump shaft 14 is not disturbed.

Figure 3:
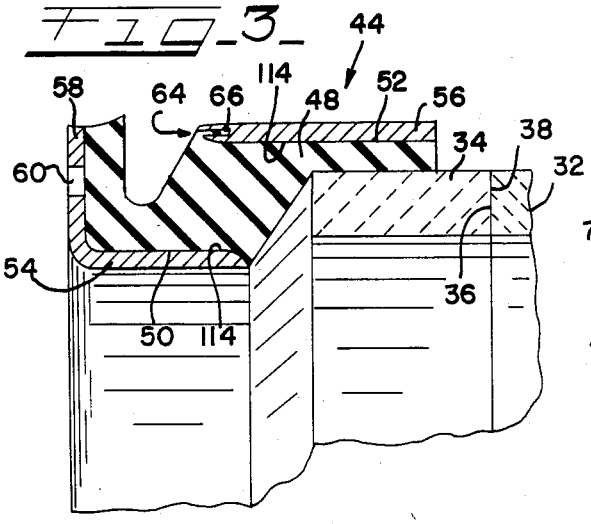
FIG. 3 is an enlarged partial cross sectional view of an elastomeric assembly of the FIG. 2 embodiment before the elastomer is stressed.

The seal assembly 12 also includes a unitized elastomeric seal ring carrier or support assembly, designated generally as 44. In the preferred embodiment and as illustrated in FIGS. 2 and 3, the elastomeric assembly 44 is mounted behind the seal ring 34 and provides an axial biasing force for maintaining the seal faces 36 and 38 in sliding engagement relative to each other. One salient feature of the elastomeric support assembly 44 is an annular core of elastomeric material 48 preferably structured from rubber having a Shore hardness of 50 to 60. The annular elastomeric member 48 is provided with inner and outer generally cylindrical surfaces 50 and 52, respectively. Chemically bonded in sealing engagement with the surfaces 50 and 52 are a pair of nonresilient axially and radially spaced annular rings 54 and 56. The inner and outer rings 54 and 56 are preferably constructed of stainless steel or other suitable metal. When operatively arranged in the pump, the elastomer assembly cross section provides for tensile and compressive force components which limit the transmission of hydraulic pressure forces to the sealing faces 36 and 38 of the seal assembly.

Figure 5:
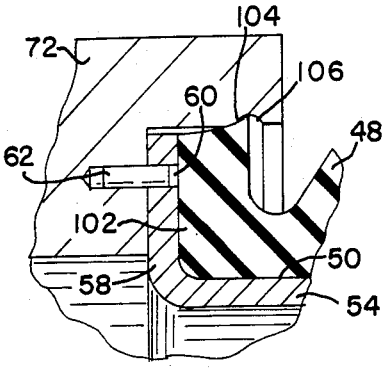
FIG. 5 is an enlarged partial cross sectional view of the means for mounting the elastomeric assembly.

As best illustrated in FIG. 5, the inner band or ring 54 includes a radial flange portion 58 whose diameter is greater than the diameter of seal ring 34 and which acts as a mounting flange which maintains the elastomer assembly and seal ring 34 carried thereby in nonrotating relation relative the rotating ring 32. The flange portion 58 may be provided with a series of circumferentially spaced apertures 60 which accommodate the free end of drive pins 62 carried by a seal ring carrier member 72. Returning to FIGS. 2 and 3, the bands 54 and 56 act as reinforcing elements for the elastomeric core member 48. Because of their location and orientation, the rings 54 and 56 will cause that portion of the annular elastomeric body 48 disposed between the rings 54 and 56 to be placed in shear as the outer band ring 56 is urged to the left (as seen in FIGS. 2 and 3) over the inner band ring 54 when the elastomeric assembly 44 is modulated into its operative position within the pump housing. That is, as seal ring 34 is moved into an operative position within the pump housing and is urged toward the other seal ring 32, the outer band or ring 56 of the elastomeric assembly will be urged or biased to the left (as seen in FIGS. 2 and 3) over and above the inner band 54. Such action places internal shear stresses in the annular body 48 over substantially the entire cross sectional area between the two rings 54 and 56, thereby resiliently urging the face 38 of ring 34 against the face 36 of ring 32.

Figure 4:
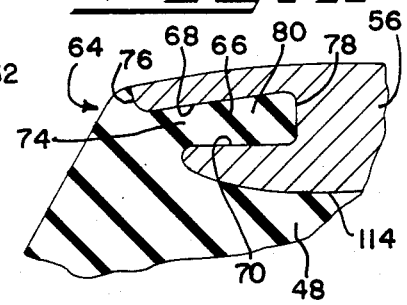
FIG. 4 is an enlarged partial cross sectional view of a portion of the elastomeric assembly illustrated in FIG. 3.

As pointed out above, an important aspect of the present invention is to assure that the elastomeric member 48 remains securely engaged with the metallic rings 54 and 56. To assure that end, the inner and outer metal rings 54 and 56 respectively, are securely joined to the respective inner and outer cylindrical surfaces of the elastomer member 48 through a chemical bond normally capable of withstanding torque loading. As illustrated in FIGS. 3 and 4, and as described hereinafter, the surface areas 114 are treated with a chemical bonding agent to secure the support rings to the elastomer body. The juncture or joint of the outer ring 56 and the elastomeric body 48, however, is especially susceptible to failure because of the internal shear stresses of the rubber, the additional deteriorative effects of the increased pressure, and caustic/corrosive exposure. The corrosive effect of the pump product along with the increased pressure attacks the chemical bond and often causes the rubber or elastomeric body to separate from the support ring 56. Once a separation has occurred between the rubber body 48 and the ring 56, caustic/corrosive matter can enter therebetween resulting in further damage to the chemical bond and sealing relationship between the elements and, ultimately, in seal failure.

To overcome the problem of the elastomer body separating from the support ring, protective mechanical seal means 64, best illustrated in FIGS. 3 and 4, are positioned proximate the bonded edge or joint of the elastomeric member 48 and its exposed support ring 56. Such mechanical means are not intended to nor do they replace the chemical bonding agent used for securing the elastomer body to the rings in the region where the elastomer body and rings are chemically joined yet exposed to high pressure and caustic matter. That is, the mechanical seal means 64 are arranged in a nontorque transmissive capacity. Instead, the cooperative mechanical means 64 of the present invention protect the chemical bonding agent against exposure to the pump product. The protective means 64 includes an annular channel or groove 66 in the outer ring 56. In the embodiment illustrated in FIGS. 3 and 4, the channel or groove 66 is defined by two walls 68 and 70 which extend longitudinally along the outer ring 56 away from an opening 74 provided in the marginal edge 76 of the ring 56. The two side walls 68 and 70 are connected by an end wall 78. An integral extension or projection 80 of the elastomer body flows into the channel 66 during a vulcanizing process used to manufacture the support ring assembly 44. Thereafter, the uppermost rim or wall 68 of the outer ring is forcibly urged toward the other wall 70 whereby crimping or squeezing the vulcanized rubber material in the area of the opening 74. As is apparent from FIG. 4, the cross sectional width of the channel enlarges from the opening 74 to the rearmost extent of the channel 66. By this construction, and especially when the elastomer body is placed in shear, the caustic pump product is prevented from reaching the surface area 114. As such, the corrosive pump product cannot attack the chemical bond established between the elastomer body and the ring.

Figure 6:
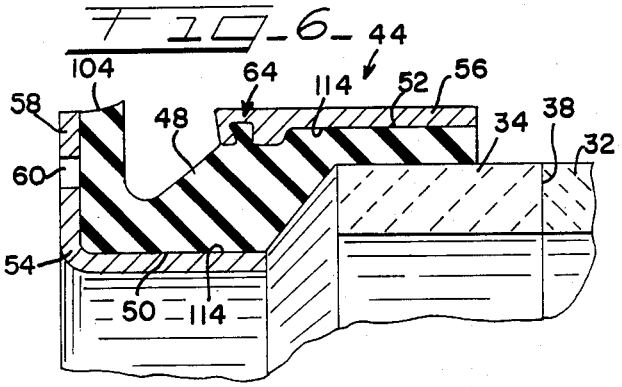
FIG. 6 is an enlarged partial cross sectional view of a second embodiment of an elastomeric assembly illustrated before the elastomer is stressed.
Figure 7:
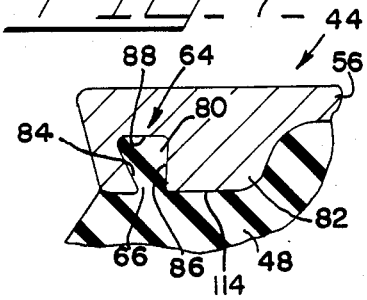
FIG. 7 is an enlarged partial cross sectional view of a portion of the elastomer assembly depicted in FIG. 6.

FIGS. 6 through 8 illustrate a portion of an alternative construction of a unitized elastomeric support assembly according to this invention. The alternative elastomer assembly illustrated in FIGS. 6 through 8 differs mainly from that illustrated in FIGS. 2 through 5 by the substitution of different types of mechanical coacting protective means which substantially duplicates the essential function of that discussed above. Corresponding parts in FIGS. 6 through 8 are identified with the same reference characters as in FIGS. 3 and 4 although the description which follows is generally limited to the differences in structural arrangement of the two embodiments. As seen in FIG. 6, the elastomeric support assembly 44 includes an annular elastomeric member 48 whose inner and outer circumferential edges 50 and 52, respectively, sealingly engage and are chemically bonded to non resilient annular rings 54 and 56. When operationally disposed within the pump housing, the cross sectional area of the elastomeric member disposed between the rings 54 and 56 is loaded in shear whereby the nonrotating seal ring 34 carried thereby is axially urged toward the other seal ring 32. At one end, and as additionally seen in FIG. 7, the outer ring 56 is provided with an enlarged annular depending section 82.

The mechanical coacting means of this embodiment 64 serves to protect the chemical bond established between or interjacent the rubber or elastomer body 48 and the outer ring 56 and includes an open ended annular chamber or groove 66 formed in the depending section 82 of the ring 56. In the embodiment illustrated in FIGS. 6 through 8, the annular chamber or groove is radially disposed and includes two generally vertical walls 84 and 86 which are connected by a transversally extending wall 88. An integral extension or projection 80 of the elastomer body 48 flows into the channel or groove 66 during a vulcanizing process used in manufacturing the support ring assembly 44. Either during the vulcanizing process or in a following process, the wall 84 of the channel 66 is forcibly urged toward the other wall 86 whereby crimping the vulcanized elastomer material projecting into the channel opening 74. Such crimping action along with the effect on the mechanical means created by the internal shear stress of the rubber prevents pump product from entering into the chamber and further prevents destruction and/or deterioration of the chemical bond established between the elastomer body and the outer support ring.

Figure 9:
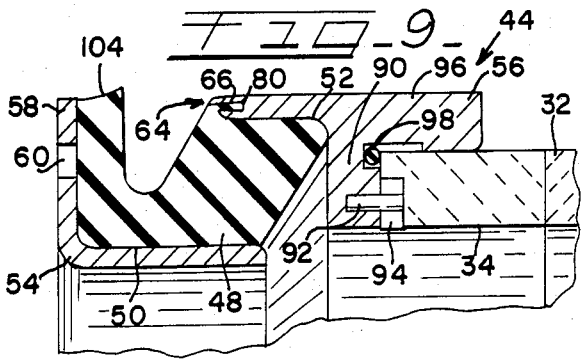
FIG. 9 is an enlarged partial cross sectional view of an additional embodiment of elastomeric assembly for mounting one of the seal rings and illustrated before the elastomer is stressed.

FIG. 9 illustrates a portion of another alternative construction of a unitized elastomer support assembly according to this invention. Corresponding parts in FIG. 9 are identified with the same reference characters as in FIG. 2 and the following description is limited to the differences and structural arrangement of the two embodiments. The elastomer support assembly 44 of FIG. 9 includes an annular elastomer member 48 whose inner and outer edges 50 and 52, respectively, are chemically bonded to nonresilient metal rings 54 and 56. Like the other embodiments, the chemical bond between the outer ring 56 and the elastomer core member 48 is protected by coacting mechanical means including a channel or groove 66 provided in the ring 56 and which is substantially filled with a vulcanized extension or projection 80 of the elastomer body 48. In this embodiment, the outer ring 56 includes a depending annular extension 90 disposed contiguous to both the resilient annular body or sleeve 48 and the nonrotating seal ring 34. The depending annular extension 90 may include a series of circumferentially disposed pins 92 the free end of which operatively engage suitably formed detents 94 provided on the sealing ring 34 thus yielding greater torque transmission capability to this mechanical arrangement than the pressfit arrangement illustrated in the other drawings. A lateral extension 96 of the ring 56 serves as a support for the nonrotating ring 34. As seen in FIG. 9, an "O" ring seal 98 may be disposed intermediate the extension 90 and the seal ring 34 for preventing the passage of pump product thereby.

As best seen in FIG. 5, an extension 102 of the elastomer body 48 extends adjacent and is chemically bonded to the radial flange portion 58 of the ring 54. To prevent corrosive pump product from destroying the chemical bond therebetween, the extension 102 is provided with a conical surface 104 the free end of which is accommodated within a suitable annular recessed groove 106 provided on the seal carrier bracket means 72 of the seal carrier assembly means 100 (FIG. 2). Although numerous designs are possible, in the preferred design, the conical surface 104 and the groove 106 are complimentary to one another and form part of a static seal arrangement between the high and low pressure in this region. That is, by providing that the diameter of the radial flange portion 58 is sufficiently greater than the diameter of seal ring 34, the pressure in chamber 28 urges the extension 102 with conical surface 104 and flange 58 into firm contact with the seal ring carrier member 72. Understandably, the sealing effect between these members increases as a function of the increase in pressure in chamber 28. The cooperative relationship between these parts provides a static seal which protects against secondary leakage between the elastomeric assembly and the carrier 72 and which prevents corrosive matter from attacking the chemical bonding agent securing the extension 102 to the radial flange 58. The surface 104 and its releasable engagement with the groove 106 also facilitates the installation and removal of the seal assembly by maintaining the unitized elastomer support assemblage 44 in operative association with the seal carrier assembly means 100 when the seal ring 34 is initially placed in the pump housing.

Figure 10:
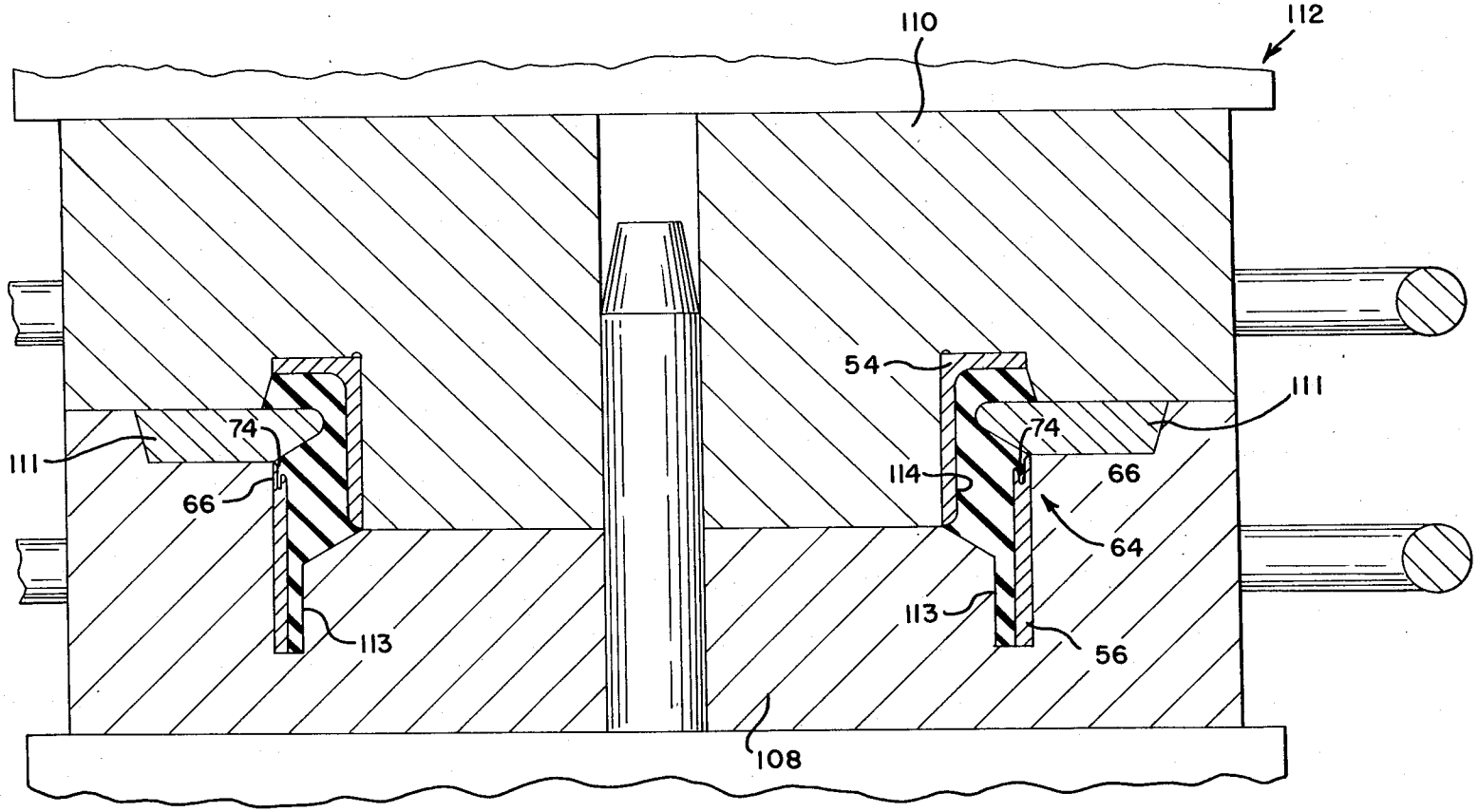
FIG. 10 is a schematic illustration of an apparatus used during the vulcanizing process of the elastomer assembly.

Referring now to FIG. 10, wherein there is schematically illustrated a vulcanizing apparatus 112 for forming the unitized elastomer support assembly 44. The elastomer assemblage 44 is formed by initially arranging the metal support rings 54 and 56 in an axially and radially spaced fixed relation in the dies 108 and 110 of the vulcanizing apparatus 112. The groove or channel 66, providing a portion of the mechanical protection means 64, has already been provided or formed in the outer ring 56 at this stage. Moreover, the surface areas generally depicted in FIGS. 3, 6 and 10 as 114 are treated with a suitable chemical bonding agent prior to the injection or insertion of elastomeric material between the rings. The rings 54 and 56 are secured together when the elastomer material is introduced therebetween during the vulcanizing process. Understandably, vulcanized material is also introduced into the open ended channel or groove 66 during this vulcanizing process. The dies 108 and 110 and associated inserts 111 carried thereby appropriately form and support the elastomer body during the vulcanizing process.

Figure 8A:
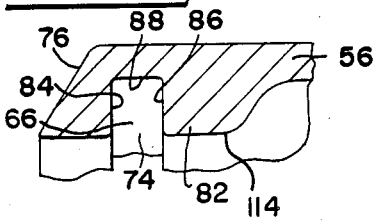
FIGS. 8A through 8C illustrate various stages in the forming process of the elastomer assembly illustrated in FIG. 6.
Figure 8C:
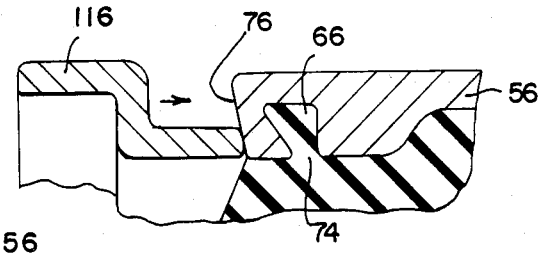
Figure 8B:
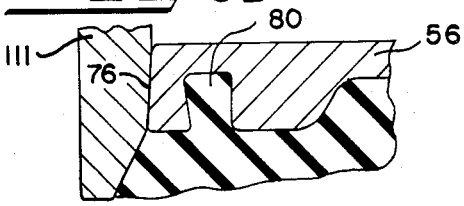

As mentioned above, the vulcanized product extending through the opening 74 of the channel 66 is crimped for purposes described above. This crimping operation may be accomplished subsequent to the vulcanizing process, concurrently therewith, or a combination of both. As depicted in FIGS. 8A through 8C, in one embodiment, the outer ring 56 may be originally formed with an annularly disposed marginal edge 76. During the vulcanizing process, and as the dies 108 and 110 squeeze together, the insertable dies 111 (see FIG. 8B) disposed in the forming apparatus engage edge 76 and cause one wall 84 of the channel 66 to be forcibly urged toward the other wall 86 whereby crimping the vulcanized material situated in the ingress means 74 to the channel 66. FIG. 8B also schematically illustrates what the channel cross section of the elastomer assembly may resemble upon removal from the apparatus 112. To assure a sealant relationship, a further crimping operation, by means of suitable tooling 116 (see FIG. 8C) may be included to further crimp the opening or ingress area 74 of the channel 66. To assure the introduction of material into substantially the entire length of the channel, a vacuum may be created therewithin before the elastomer material is introduced between the rings. The vacuum may be created within the die set or vulcanizing apparatus 112 by suitably formed channels connected to a source of reduced pressure.

Figure 11:
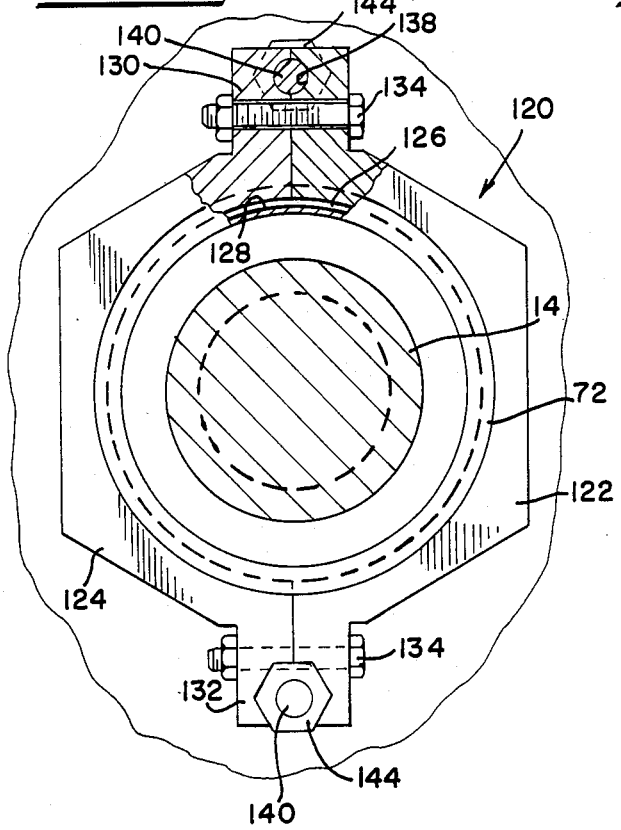
FIG. 11 is an end view taken along line 11—11 of FIG. 2.
Figure 12:
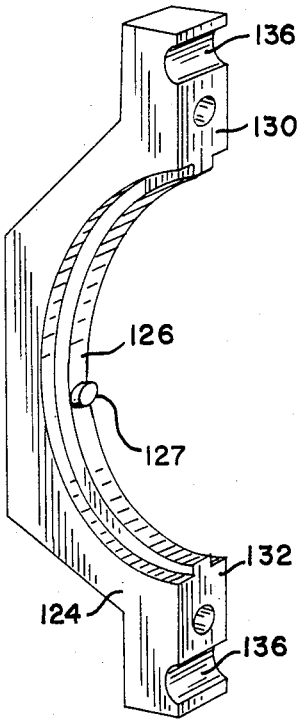
FIG. 12 is a perspective view of a portion of the bracket assembly illustrated in FIG. 11.

Returning to FIG. 2, axially adjustable seal carrier assembly means 100 are provided for mounting the nonrotating seal ring 34 from the impeller side of the housing. As best illustrated in FIG. 2, the mounting or carrier means 100 includes a tubular member or bracket means 72 which is telescopically arranged over the pump drive shaft 14. The unitized elastomer assembly 44 is operatively associated with the free end 73 of the bracket means 72 by means described above. Mounting bracket means 120 are secured and pin connected as at 127 to the opposite side of the bracket 72. In this embodiment, and as best illustrated in FIGS. 2, 11 and 12, the mounting bracket means 120 is comprised of a complimentary pair of apertured "C" blocks 122 and 124. A skilled artesian may well invision how adjustable "C" bolts could be arranged to effect these same ends. In the illustrated embodiment, the "C" blocks each include an annular projection 126 arranged for insertion into an annular groove 128 provided about the periphery of the tubular member 72. Each "C" block is provided with an upper and lower extending flange portions 130 and 132, respectively, which are releasably secured together by suitable fastening means 134. The flange portions of each "C" block are provided or formed with complimentary cutouts 136 (FIG. 12) which, when assembled, define suitable openings or apertures 138. These openings 138 are arranged and suitably proportioned to accommodate threaded members 140 extending from a wall 142 (FIG. 2) of the housing 18. To axially position the seal carrier bracket 72 and thereby move the inner support ring 54 relative to the outer support ring 56 thereby stressing the elastomer core member 48 in shear therebetween and thereby moving the seal ring 34 toward seal ring 32, operator accessible adjustable means or nuts 144 carried on the opposite sides of the flange portions 130 and 132, serve to lock the seal carrier bracket 72 and thus the seal ring 34 in any desired axial positon. If desired, the axial disposition of the bracket 72 and thereby the stress on the seal assembly may be modulated, while the pump operates, through axial modulation of member 144. This construction further permits extended axial modulation of the impeller 16 through the adjustment means described above.

From the above description, it is apparent that an improved form of elastomer seal ring carrier assembly has been provided. Although the elastomer body and outer seal ring support of the unitized support assembly remain exposed to caustic and/or corrosive pressurized pump product, the possibility of the elastomer separating from its supporting ring as a result of such exposure has been minimized. The mechanical seal 64 provided between the elastomer body 48 and the outer support ring 56 will prevent the pump product from chemically attacking the bond between these components despite the harsh operating environment in which the unitized support assembly is disposed. The projection of an integral part or extension 80 of the elastomer body into the channel 66 on the outer ring provides a protective barrier which protects the chemical bond between these elements and which is not susceptible to chemical attack and pressure.

Thus, there has been provided an Improved Mechanical Seal for Pumps and Method of Fabricating Same which fully satisfies the objects, aims and advantages setforth above. While the invention has been described in connection with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A mechanical seal assembly for use with pumps having a pump housing and a driven shaft driving a pump impeller, said seal assembly comprising:

a rotatable seal ring operatively connected to and driven with said shaft;

a nonrotatable seal ring operatively secured to said housing, each of said seal rings having a face opposing the face of the other seal ring and adapted to cooperate in a sealing relationship therewith; and an elastomeric assembly supporting one of said seal rings and creating a biasing axial force for maintaining the seal faces in sliding engagement relative to each other, said elastomeric assembly including an annular elastomeric member having inner and outer generally cylindrical surfaces, inner and outer metal support rings joined to the inner and outer cylindrical surfaces of said elastomeric member through a chemical bond normally capable of withstanding torque loading, with said outer support ring and said elastomeric member being provided with mechanical cooperative means positioned proximate the outermost bonded edge of said elastomeric member in a nontorque transmissive capacity for protecting the chemically bonded joint established between the elastomeric member and said outer support ring, the zone between said inner and outer support rings being loaded in shear when the elastomeric assembly is placed in an operative position.

2. The seal assembly of claim 1 wherein said mechanical cooperative means comprises a channel provided in said outer support ring and into which an extension of said elastomeric member extends in a sealant manner.

3. The seal assembly of claim 1 wherein said mechanical cooperative means comprises a longitudinally disposed channel provided in said outer support ring and into which an integral portion of said elastomeric member flows during a vulcanizing process.

4. The seal assembly of claim 3 wherein said channel is defined by two side walls which longitudinally extend from an opening to an end wall which connects the two side walls and wherein the cross sectional design of the channel prevents pump product from entering the channel.

5. The seal assembly of claim 1 wherein said mechanical cooperative means comprises a radially disposed groove provided in said outer support ring and into which an extension of said elastomeric member is inserted during a vulcanizing process.

6. A shaft seal assembly for a pump having a housing rotatably supporting a driven shaft, said seal assembly comprising:

a nonrotating seal ring operably carried by said housing;

a rotating seal ring arranged in end face mutual contact with said non rotating seal ring and carried for rotation on said shaft; and a unitized elastomer seal ring carrier assembly, said elastomer assembly including first and second radially spaced nonresilient support rings carried by said housing and which are secured to first and second cylindrical edges of an annular elastomeric seal ring supporting member through a chemical bond capable of withstanding torque loading, a body portion of said annular elastomeric seal ring supporting member between said support rings being loaded in shear and exposed to pump product when the elastomer assembly is operatively arranged in the pump housing, and wherein a protective mechanical seal is disposed interjacent the exposed body portion of said annular elastomeric seal ring supporting member and one of the nonresilient support rings in a nontorque transmissive capacity and in a manner protecting the chemical bond between the bonded edge of the annular elastomeric seal ring supporting member and the associated nonresilient support ring against attack by the pump product.

7. The seal assembly of claim 6 wherein said mechanical seal includes a channel provided on said one of the nonresilient support rings, which channel accommodates, in a sealant manner, an integral extension of said elastomeric member.

8. The seal assembly of claim 6 wherein said mechanical seal means comprises a longitudinally extended opening into which an integral extension of said elastomeric member flows during a vulcanizing process.

9. The seal assembly of claim 6 wherein said mechanical seal means comprises a channel into which an integral extension of said elastomeric member flows during a vulcanizing process.

10. The seal assembly of claim 6 wherein said mechanical seal means comprises a radially disposed channel into which an integral portion of said elastomeric member flows during a vulcanizing process.

11. In combination with a pump having a housing supporting a rotatably driven shaft connected to an impeller, a mechanical seal assembly comprising:

a nonrotating seal ring surrounding said shaft and carried by said housing;

a rotatable seal ring surrounding said shaft and operably driven thereby, said seal rings being urged into end face mutual contact; and a resilient seal ring mounting assembly which relies on internal shear stresses for urging the nonrotating seal ring into sliding engagement with the relatively rotating seal ring whereby creating a dynamic seal therebetween, said resilient mounting structure including inner and outer axially and radially spaced nonresilient annular band members, an annular elastomeric member whose inner and outer edges are joined to the respective nonresilient annular band members through a chemical bond capable of withstanding torque loading but which is subject to preferential attack by pump product, said elastomeric member and said outer nonresilient annular band member being provided with mechanical coacting means arranged proximate the outermost bonded edge of said elastomeric member in a nontorque transmission capacity for protecting the chemical bond from chemical attack by pump product.

12. The mechanical seal assembly of claim 11 wherein said seal rings are comprised of ceramic materials.

13. The mechanical seal assembly of claim 11 wherein said nonresilient annular members are comprised of metal rings.

14. The mechanical seal assembly of claim 11 wherein said mechanical coacting means includes an open ended channel provided in said outer nonresilient annular band member, which channel is substantially filled with an extension of said elastomeric member during a vulcanization process.

15. The mechanical seal assembly of claim 11 wherein said mechanical coacting means include an open ended longitudinally disposed groove provided on said outer nonresilient annular band member, which groove accommodates, in a sealant manner, a vulcanized extension of said elastomeric member.

16. The mechanical seal assembly of claim 11 wherein said mechanical coacting means includes an open ended radially disposed channel provided on said outer nonresilient annular band member into which is inserted a vulcanized extension of said elastomeric member.

17. A mechanical seal arrangement for a pump having a housing, a rotary assembly in said housing including a rotatable drive shaft and a pump impeller connected to said drive shaft, said seal arrangement comprising:

a pair of seal rings surrounding said shaft with seal faces opposing one another in a manner retarding the passage of pump product from a pressurized zone to another zone, one of said seal rings being rotatable with said shaft and impeller and the other seal ring being nonrotatable; and means for mounting said nonrotating seal ring from the impeller side of the housing, said mounting means including seal ring carrier means adjustably carried by said housing, a unitized elastomer assembly operably connected to said seal ring carrier means for resiliently mounting said nonrotating seal ring from the impeller side of the housing, said unitized elastomer assembly including an annular elastomer member having inner and outer metal support rings securely joined to its respective inner and outer cylindrical surfaces through a chemical bond capable of withstanding torque loading, said inner metal support ring being secured to a free end of said seal ring carrier means and the outer metal support ring being exposed to the pump product in the pressurized zone of the pump, and wherein mechanical means are cooperatively arranged in a nontorque transmissive capacity between said outer metal support ring and the elastomer assembly in a manner protecting the chemical bond therebetween against attack by pump product, the zone between said inner and outer metal support rings being loaded in shear when the elastomer assembly is placed in an operative position.

18. The mechanical seal arrangement of claim 17 wherein said seal ring carrier means includes cylindrical bracket means telescopically arranged over said drive shaft.

19. The mechanical seal arrangement of claim 18 wherein said seal ring carrier means includes means for axially adjusting the disposition of said nonrotating seal ring relative to said housing.

20. The mechanical seal arrangement of claim 17 wherein said mechanical means comprises an open ended channel provided on said outer metal support ring which sealingly accommodates a vulcanized extension of said elastomer member.

21. The mechanical seal arrangement of claim 20 wherein said channel has a cross sectional configuration which prevents wicking of the pressurized pump product into said channel.

22. The mechanical seal arrangement of claim 17 wherein said mechanical means comprises an open ended longitudinal groove provided on said outer metal support ring and into which a vulcanized extension of said elastomer member is inserted.

23. The invention according to claim 17 wherein said mechanical means comprises a radially disposed channel provided on said outer metal support ring and into which a vulcanized projection of said elastomer member is securely received.

24. The invention according to claim 17 wherein a static seal is provided between said unitized elastomer assembly and said seal ring carrier means for preventing secondary leakage therebetween.

25. In combination with a pump adapted to move a corrosive pump product and which includes a housing, a rotatable assemblage including a rotatable shaft and an impeller, a mechanical seal assembly for retarding the leakage of pump product along the shaft and between a chamber wherein high pressure flow is created by impeller action and another area, said mechanical seal assembly comprising:

a nonrotatable seal ring operably secured to said housing;

a rotatable seal ring adapted to rotate with said shaft and impeller;

a unitized mounting arrangement for said nonrotatable seal ring, said mounting arrangement including an outer support ring for supporting the nonrotating seal ring, an inner support ring radially and axially spaced from said outer support ring and operably connected to said housing, an elastomeric annular sleeve securely interposed between and joined to said support rings through a chemical bond capable of withstanding torque loading, said elastomeric annular sleeve serving to support and yieldingly apply axial pressure to said nonrotating seal ring when the area between said support rings is loaded in shear such that the seal face of said nonrotating seal ring is urged into sealing engagement with the seal face of the rotating seal ring, and wherein cooperative mechanical means are cooperatively arranged in a nontorque transmissive capacity between said sleeve and said outer support ring in a manner protecting the chemical bond therebetween from exposure to and attack by pump product and pressure.

26. The mechanical seal assembly according to claim 25 wherein said outer support ring includes a depending annular extension disposed contiguous to said nonrotating seal ring for transferring heat to the outer support ring and ultimately to the pump product.

27. The mechanical seal assembly according to claim 26 wherein said depending annular extension includes a plurality of radially disposed projections which engage and transmit torque capabilities to the adjacent seal ring.

28. The mechanical seal assembly of claim 27 wherein said cooperative mechanical securement means includes an open ended chamber into which a vulcanized extension of said elastomeric annular sleeve is inserted to create a mechanical bond therebetween.

* * * * *